US006318855B1

(12) United States Patent
Kawaguchi

(10) Patent No.: US 6,318,855 B1
(45) Date of Patent: Nov. 20, 2001

(54) SHEET MATERIAL FEEDING APPARATUS AND RECORDING APPARATUS

(75) Inventor: Koichiro Kawaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/370,908

(22) Filed: Aug. 10, 1999

(30) Foreign Application Priority Data

Aug. 20, 1998 (JP) ..... 10-234394

(51) Int. Cl.[7] ..... B41J 2/01; B41J 11/58; B65H 5/00

(52) U.S. Cl. ..... 347/104; 400/624; 271/10.09

(58) Field of Search ..... 347/102, 104; 400/605, 624, 625, 629, 634, 636, 641; 271/10.09

(56) References Cited

U.S. PATENT DOCUMENTS 4,933,684 * 6/1990 Tasaki et al. ..... 347/102
5,533,822 * 7/1996 Tsukada et al. ..... 347/104
5,540,423 * 7/1996 Nakano ..... 347/104
5,580,042 * 12/1996 Taniguro et al. ..... 347/104
5,648,808 * 7/1997 Yanagi et al. ..... 347/104
5,850,235 * 12/1998 Saito et al. ..... 347/104
5,857,671 * 1/1999 Kato et al. ..... 347/104

FOREIGN PATENT DOCUMENTS

000168734A2 * 1/1986 (EP) ..... 342/104

* cited by examiner

*Primary Examiner*—Eugene Eickholt
(74) *Attorney, Agent, or Firm*—Fitzpatrick, Cella, Harper & Scinto

(57) ABSTRACT

Present invention relates to a sheet material feeding apparatus comprising sheet material stacking means, sheet material feeding means, separation means for separating the sheet materials fed by the sheet material feeding means one by one; and a guide member for guiding one side end of the sheet material. The sheet material feeding means includes first, second, and third feeding rotary members, which are respectively formed with a sheet material contacting surface made of a high frictional material, coaxially positioned in this order from a location closer to the guide member, wherein a maximum outer diameter of the second rotary member is larger than a maximum outer diameter of the first rotary member.

8 Claims, 12 Drawing Sheets

SHEET MATERIAL FEEDING APPARATUS AND RECORDING APPARATUS

BACKGROUND OF THE INVENTION

1. Field of the Invention

This invention relates to a sheet material feeding apparatus mounted in a recording apparatus such as a facsimile machine, a photocopier, a printer, and so on and, more particularly, to a sheet material feeding apparatus for automatically feeding a sheet material sheet by sheet in a separated manner.

2. Description of Related Art

As methods for feeding sheet materials used in a recording apparatus., conventionally known are to manually feed the sheet materials sheet by sheet and to automatically and successively feed the sheet materials using an automatic feeding apparatus.

When the sheet materials are automatically and successively fed sheet by sheet using such an automatic feeding apparatus, a pawl separation method in which a separation pawl clamps front end corners of the sheet materials, a frictional separation method in which friction between the sheet materials and a sheet material stacking means renders the sheet materials separated, and the like are widely used as a separation method for sheet materials. In such a conventional method, various devises are made to reduce oblique feeding of the sheet materials during separation and feeding of the sheet materials.

Meanwhile in Japan, postcards such as New Year greeting cards, direct mails, various receipts in simpler forms, and the like are used in a large volume as communication means. The volume of those printed matters is so huge, while many recording apparatuses as of inkjet recording apparatuses are put in the market with photographic printing quality. Therefore, it is desirable for feeding apparatuses to feed postcards accurately.

For example, in an art disclosed in Japanese Unexamined Patent Publication (KOKAI) No. Heisei 7-165,338 (first prior art), the sheet materials are corrected from fed obliquely by partially separating a feeding roller from the sheet material during feeding of the sheet materials. In an art disclosed in Japanese Unexamined Patent Publication (KOKAI) No. Heisei 6-305,585 (second prior art), guide members are provided in corresponding to sizes of the sheet materials to eliminate occurrence of oblique feeding regardless size of the sheet materials.

However, with respect to the above prior arts, in the first prior art in which the sheet materials are corrected from fed obliquely by partially separating a feeding roller from the sheet material during feeding of the sheet materials, the separation means may create pressing traces on the sheet materials during separation operation of the feeding roller and the sheet materials, thereby raising a problem on quality in recording. In a case that the sheet material is a postcard, since the card is fed by a single feeding roller, separation of the feeding roller does not so work, and therefore the oblique feeding cannot be prevented enough.

In the second prior art in which the guide members are formed in corresponding to sizes of the sheet materials, a user has to manipulate different guide members according to the sizes of the sheet materials, and this mechanism renders usage of the apparatus worse and may invite improper manipulation.

This invention is to solve the above problems. It is an object of the invention to provide a sheet material feeding apparatus easily used in preventing any sheet material including a postcard from fed obliquely without adding any pressing trace and to provide a recording apparatus incorporating this feeding apparatus.

SUMMARY OF THE INVENTION

A representative structure of a sheet material feeding apparatus according to the invention to accomplish the above objects includes a sheet material stacking means for stacking sheet materials; a sheet material feeding means for feeding the sheet materials stacked on the sheet material stacking means; a separation means for separating the sheet materials sheet by sheet; and a guide member for guiding one side end of the sheet material, wherein the sheet material feeding means includes first, second, and third feeding rotary members, which are respectively formed with a sheet material contacting surface made of a high frictional material, coaxially positioned in this order from a location closer to the guide member, wherein an outer diameter of one portion of each of the first and second rotary members is different from an outer diameter of other portion of each of the first and second rotary members, and wherein a maximum outer diameter of the second rotary member is larger than a maximum outer diameter of the first rotary member.

According to the above structure, because the maximum outer diameter of the second rotary member located at a far side from the guide member is larger than the maximum outer diameter of the first rotary member located at a near side to the guide member, the feeding amount of the sheet material by the second feeding rotary member is more than the feeding amount of the sheet material by the first feeding rotary member, so that this apparatus can prevent the sheet material from fed obliquely by eliminating operation that the sheet material is fed by the separation means in a direction that the front end of the sheet material moves away from the guide member. Therefore, the sheet material can avoid from being fed obliquely without sacrificing usage of the apparatus as well as forming any pressing trace on the sheet material even in a case that the sheet material is in a size of a postcard or postal card.

When an outer diameter of one portion of the third rotary member is different from an outer diameter of other portion of the third rotary member, and when a maximum outer diameter of the first rotary member is larger than a maximum outer diameter of the third rotary member, because the maximum outer diameter of the first rotary member located at the near side from the guide member is larger than the maximum outer diameter of the third rotary member located at a far side to the guide member, the feeding amount of the sheet material by the first feeding rotary member is more than the feeding amount of the sheet material by the third feeding rotary member, so that the apparatus can prevent the sheet material from fed obliquely by suppressing, where no separation means is provided on the opposite side to the guide member, and where front ends of the sheet materials are set in a hanging manner on a side that the separation means does not exist, the feeding amount of the sheet material by the hanging amount of the front ends of the sheet materials. Therefore, the apparatus can prevent sheet materials such as plain paper or the like other than a postcard from fed obliquely in the same way.

Another representative structure of a sheet material feeding apparatus according to the invention includes a sheet material stacking means for stacking sheet materials; a sheet material feeding means for feeding the sheet materials stacked on the sheet material stacking means; a separation means for separating the sheet materials sheet by sheet; and a guide member for guiding one side end of the sheet material, wherein the sheet material feeding means includes first, second, and third feeding rotary members, which are respectively formed with a sheet material contacting surface made of a high frictional material, coaxially positioned in this order from a location closer to the guide member, and wherein a frictional coefficient of the second rotary member is higher than a frictional coefficient of the first rotary member.

According to the above structure, because the frictional coefficient of the second rotary member located at a far side from the guide member is larger than the frictional coefficient of the first rotary member located at a near side to the guide member, the feeding amount of the sheet material by the second feeding rotary member is consequently more than the feeding amount of the sheet material by the first feeding rotary member since the feeding force of the sheet material by the second feeding rotary member is larger than the feeding force of the sheet material by the first feeding rotary member, so that this apparatus can prevent the sheet material from fed obliquely by eliminating operation that the sheet material is fed by the separation means in a direction that the front end of the sheet material moves away from the guide member. Therefore, the sheet material can avoid from being fed obliquely without sacrificing usage of the apparatus as well as forming any pressing trace on the sheet material even in a case that the sheet material is in a size of a postcard or postal card.

In a case that the frictional coefficient of the first rotary member is higher than the frictional coefficient of the third rotary member, because the frictional coefficient of the second rotary member located at a far side from the guide member is higher than the frictional coefficient of the first rotary member located at a near side to the guide member, the feeding amount of the sheet material by the first feeding rotary member is consequently more than the feeding amount of the sheet material by the third feeding rotary member since the feeding force of the sheet material by the first feeding rotary member is larger than the feeding force of the sheet material by the third feeding rotary member, so that the apparatus can prevent the sheet material from fed obliquely by suppressing, where no separation means is provided on the opposite side to the guide member, and where front ends of the sheet materials are set in a hanging manner on a side that the separation means does not exist, the feeding amount of the sheet material by the hanging amount of the front ends of the sheet materials. Therefore, the apparatus can prevent sheet materials such as plain paper or the like other than a postcard from fed obliquely in the same way.

DESCRIPTION OF PREFERRED EMBODIMENTS

Referring to drawings, an embodiment of a sheet material feeding apparatus according to the invention and an inkjet recording apparatus, as an example of a recording apparatus having the feeding apparatus, to which the sheet material feeding apparatus applies are described in detail.

Figure 1:
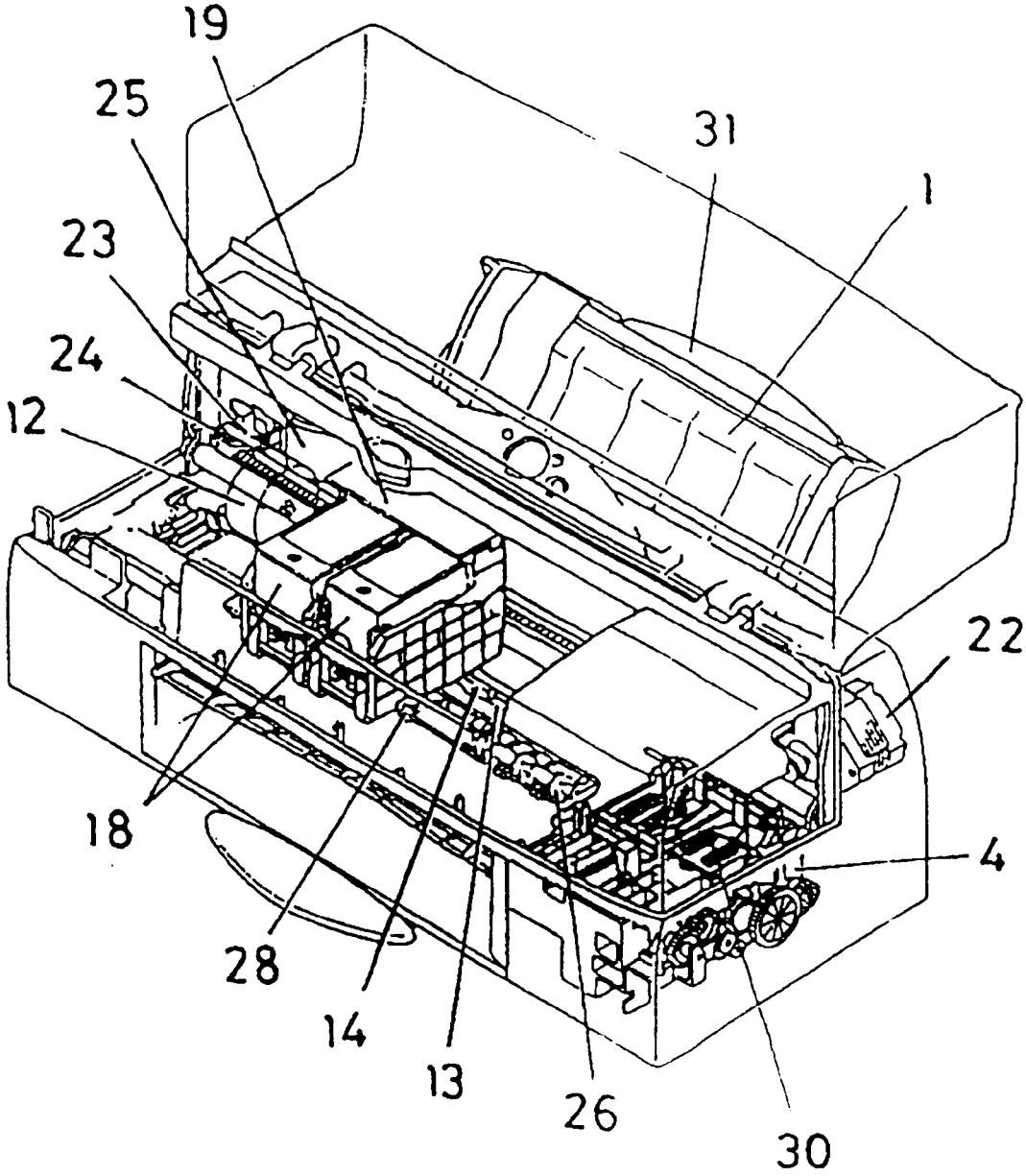
FIG. 1 is a perspective view showing a structure of a recording apparatus having a sheet material feeding apparatus according to the invention.

First, a first embodiment of the recording apparatus having the sheet material feeding apparatus according to the invention is described. The entire structure of the recording apparatus having the sheet material feeding apparatus according to the invention is described in reference to FIGS. 1 to 3. The recording apparatus of this embodiment shown in FIGS. 1 to 3 is a recording apparatus having an automatic feeding apparatus as a united body, which includes a feeding section 1, a conveyance section 2, a carriage section 3, a cleaning section 4, and so on.

Figure 2:
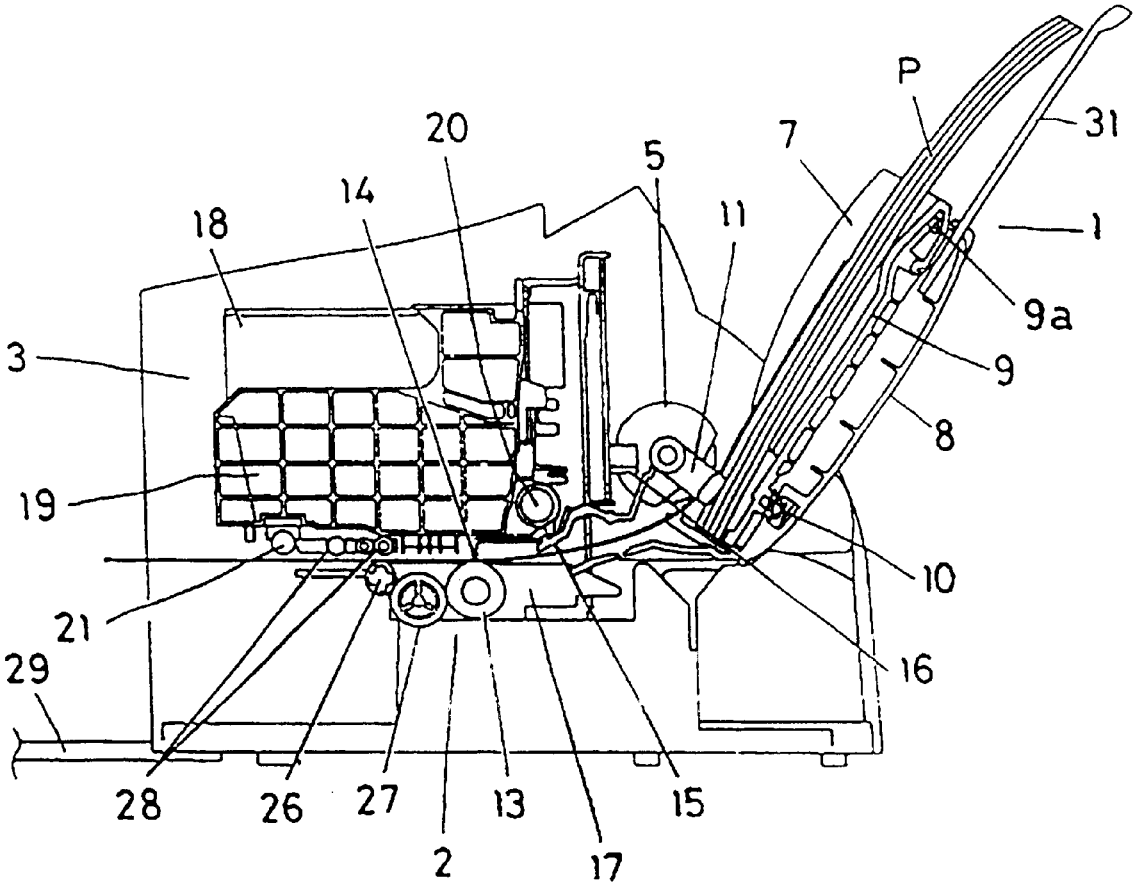
FIG. 2 is a cross-sectional view showing the structure of the recording apparatus having the sheet material feeding apparatus according to the invention.
Figure 3:
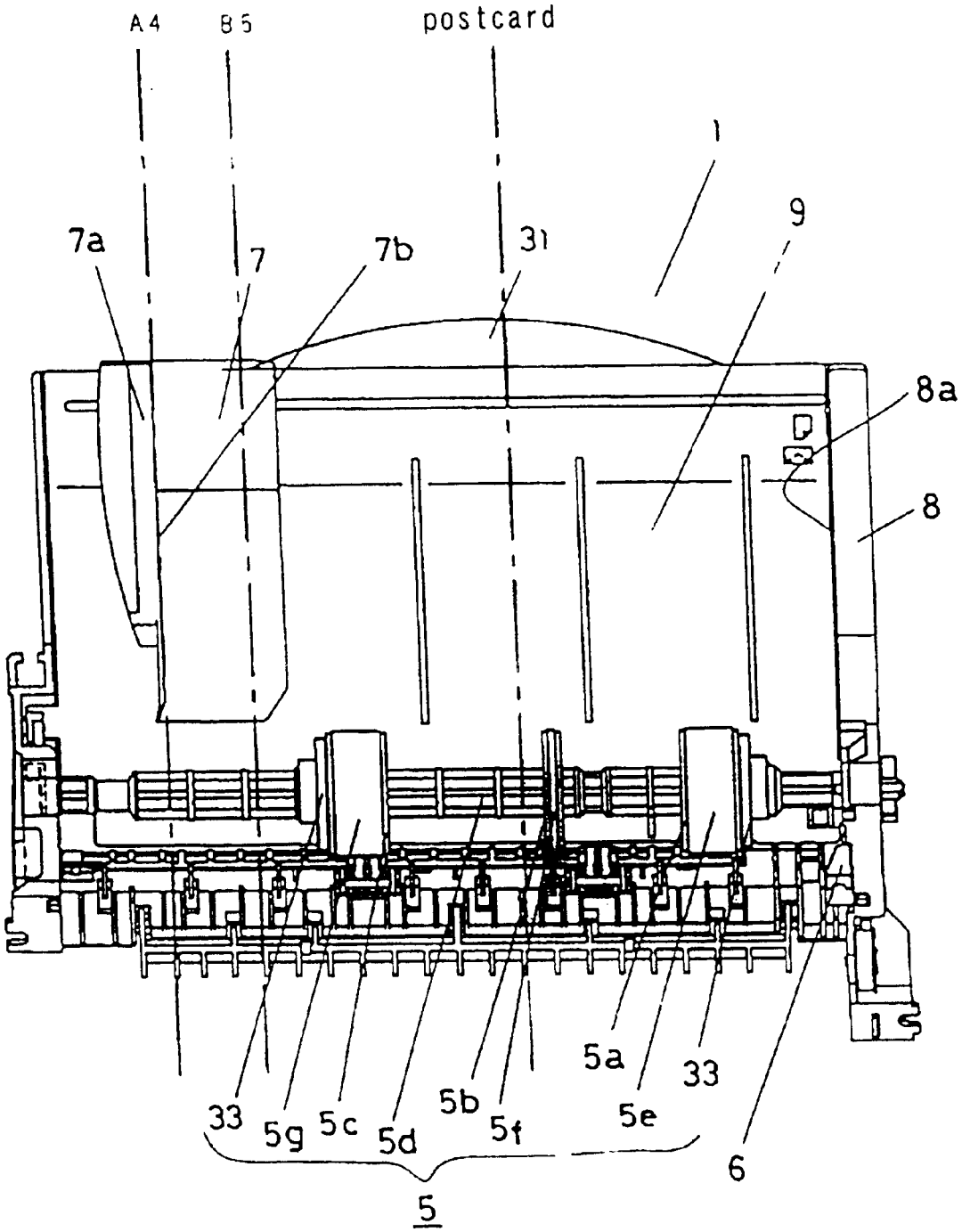
FIG. 3 is a front view showing the structure of a sheet material feeding section of the sheet material feeding apparatus according to the invention.

The feeding section 1 is mounted on a recording apparatus body with an angle of 30 to 60 degrees as shown in FIG. 2. A recording sheet P as a sheet material made of a paper or synthetic resin set to the section is delivered horizontally after printed.

The feeding section 1 is structured including a feeding roller 5 as a feeding rotary member constituting the sheet material feeding means, a separation pawl 6 serving as a separation means, a movable side guide 7, a base 8, a pressing plate 9 serving as a sheet material stacking means, a pressing plate spring 10, and a feeding cam 11.

The feeding cam 11 normally pushes down the pressing plate 9 in opposing the urging force of the pressing plate spring 10, thereby rendering the recording sheets P separated from the feeding roller 5. On the other hand, while the recording sheets P are set on the pressing plate 9, the feeding cam 11 and the feeding roller 5 rotate upon receiving drive transmission from a feeding motor 12 according to a feeding instruction. When the feeding cam 11 separates from the pressing plate 9, the pressing plate 9 moves up by urging force of the pressing plate spring 10, and the recording sheet P is picked up according to the rotation of the feeding roller 5 where the feeding roller 5 comes in contact with the recording sheet P. The sheets P are separated sheet by sheet by the separation pawl 6, and the separated recording sheet P is sent to the conveyance section 2.

The feeding roller 5 and the feeding cam 11 rotate by one turn until transferring the recording sheet P to the feeding section 2. While the pressing plate 9 is released with respect to the feeding roller 5, the feeding roller 5 is disconnected from drive power and maintains this initial state.

The conveyance section 2 is constituted of a conveyance roller 13, a pinch roller 14, a paper edge sensor lever 15, a paper edge sensor 16, a platen 17, and so on.

The recording sheet P transferred to the conveyance section 2 is conveyed upon nipped by a roller pair 13, 14 constituted of conveyance roller 13 and the pinch roller 14 where guided by the platen 17. The paper end sensor lever 15 is provided in front of the roller pair 13, 14, detects the front end of the recording sheet P, and finds the printing position on the recording sheet P.

The recording sheet P sent by the roller pair 13, 14 proceeds along the platen 17 by rotation of the roller pair 13, 14 driven by the feeding motor 12 and serves for recording based on prescribed image information with an inkjet recording head 18 as a recording means.

The recording head 18 is in a united body with an ink tank which is easily replaced. The recording head 18 has an electrothermal converter and adapts to make recordings by spraying ink through an orifice or orifices by utilizing pressure change produced by applied thermal energy.

That is, as a recording means in the recording apparatus, an inkjet recording system for recording sheets by spraying ink or inks from the recording head 18. The recording head 18 includes a very fine orifice or orifices, a liquid passage or passages, an energy operation area or areas formed at the passage, and an energy generating means for generating droplet formation energy for operating the liquid located at the energy operation area.

As such an energy generating means for generating the energy, a recording method using an electromechanical converter such as piezoelectric device or the like, a recording method for using energy generating means for spraying droplets by operation from heat generation, which is made by radiation of electromagnetic wave such as a laser beam, a recording method using energy generating means for spraying liquid by heating the liquid through an electrothermal converter such as a heater or the like having a heat generating resistor, and the like are exemplified.

The recording head used for the inkjet recording method for spraying liquid by thermal energy, among those, can record with high resolution since the orifices for forming the sprayed droplets upon spraying the liquid for recording can be arrayed with a high density.

Further, the recording head in which the electrothermal converter is used as an energy generating means is advantageous because the head can be made compact, can utilize adequately the advantages in progresses of technologies in the semiconductor field and IC technology or microfabrication technology remarkably extending reliability of the products, can be mounted with high density, and can reduce production costs.

Although in the embodiment described above the inkjet recording method is used as a recording means, it is more preferable to constitute the means to make recordings by spraying ink through orifices upon growth and contraction of bubbles produced in ink using film boiling phenomenon occurring in the ink from thermal energy applied with the electrothermal converter where the electrothermal converter is energized in response to the recording signals.

It is also preferable to use some fundamental principles as disclosed in, e.g., U.S. Pat. Nos. 4,723,129 and 4,740,796.

The carriage section 3 is constituted of a carriage 19 mounting the recording head 18 on the carriage, a guide shaft 20 for reciprocal scanning the head in a direction perpendicular to the conveyance direction of the recording sheet P, an auxiliary guide 21 for maintaining the separation interval between the recording head 18 and the recording sheet P, a timing belt 23 for transferring the drive force of a carriage motor 22 to the carriage 19, an idler pulley 24 for tensioning the timing belt 23, a flexible substrate 25 for transmitting a head drive signal from an electric circuit board to the recording head 18, and so on. Images can be formed on the recording sheet P conveyed on the platen 17 where the recording head 18 is scanned together with the carriage 19.

The delivery section includes a delivery roller 26, a transmission roller 27 for transmitting drive power of the conveyance roller 13 to the delivery roller 26, a spur 28 for assisting delivery of the recording sheet P, and a delivery tray 29. The recording sheet P is delivered onto the delivery tray 29 upon clamped by the conveyance roller 13 and the spur 28 after images are formed.

The cleaning section 4 includes a cap 30 for suppressing drying of the recording head 18, a tube pump, not shown, for cleaning the recording head, and the like.

Referring to FIG. 3 to FIG. 12, features of a sheet material feeding apparatus according to the invention are described. The feeding section 1 forms a unit in which each member of the feeding section is mounted on a base S. The feeding section 1 of this embodiment has a reference side on one side of the recording sheet P, and the inside of a right side plate of the base 8 is a sheet guide 8*a* serving as a guide member for a reference face of the recording sheets P.

A subsidiary tray 31 is retractable in the base 8 and is to support the back of the recording sheets P upon pulled out of the base 8 when recording sheets P having a relatively large size are stacked on the pressing plate 9.

Figure 4:
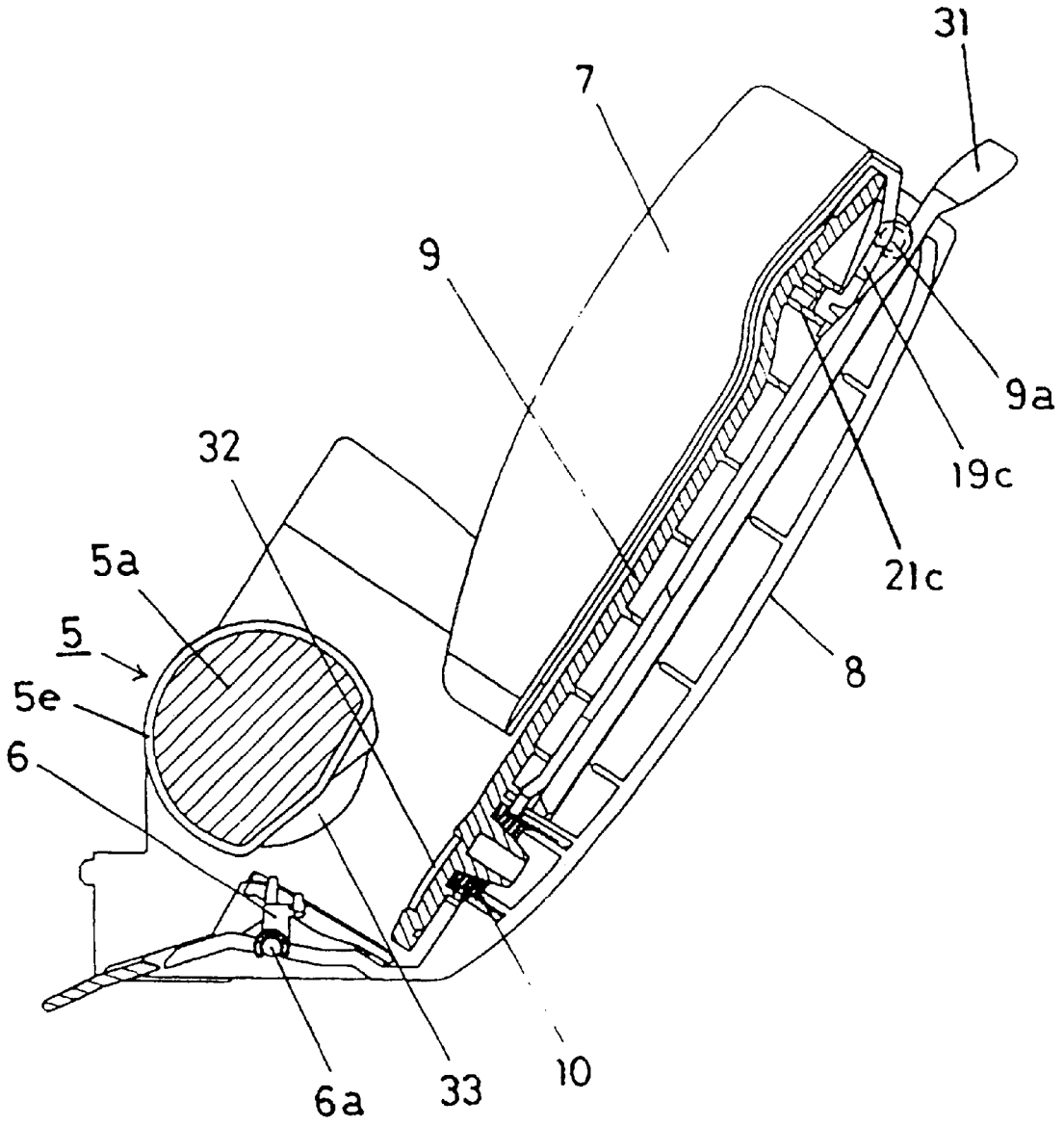
FIG. 4 is a cross-sectional view showing the structure of the sheet material feeding section of the sheet material feeding apparatus according to the invention.

As shown in FIG. 4, the pressing plate 9 is combined with the base 8 with pressing plate shafts 9*a* arranged at tops on both sides and can rotate around the pressing plate shafts 9*a*. Pressing plate springs 10 are provided at positions corresponding to the positions of a first rubber roller 5*e* and a third rubber roller 5*g* of the feeding roller 5 as described in detail below between the pressing plate 9 and the base 8 (see, FIG. 9).

Separation pads 32 made of a material having a relatively high frictional coefficient such as an artificial leather are formed on a top surface of the pressing plate 9 at the positions corresponding to the first rubber roller 5*e* and the third rubber roller 5*g*, thereby preventing the recording sheets from doubly fed when remaining recording sheets P stacked on the pressing plate 9 become few.

A movable side guide 7 is attached to the pressing plate 9 movably in the left and right directions in FIG. 3 on the pressing plate 9, so that any recording sheets having different sizes can be set in contact with the sheet guide 8*a*.

A button 7*a* is provided for manipulated by a user, and the sliding force for moving the movable side guide 7 in the right and left directions in FIG. 3 is set at about 350 to 1200 gf. Users can position the recording sheets P by contacting the recording sheet contacting surface 7*b* to the end surface of the recording sheet P.

The feeding roller 5 serving as a sheet material feeding means is rotatable where the opposite ends of the roller are held by the base 8. The feeding roller 5 includes a first roller portion 5*a* serving as a first rotary member, a second roller portion 5*b* serving as a second rotary member, and a third roller portion 5*c* serving as a third feeding rotary member, which are coaxially positioned by a common shaft portion 5*d* in this order from a location closer to the sheet guide 8*a* serving as the guide member formed on the base 8. The shaft portion 5*d*, the first to third roller portions 5*a*, 5*b*, 5*c* are molded unitedly from a plastic material or the like.

First, second, and third roller rubbers 5*e*, 5*f*, 5*g* serving as a high frictional material for conveying the recording sheets P by frictional force in contact with the recording sheets P are provided on each outer periphery of the roller portions 5*a*, 5*b*, 5*c*.

Each of the roller portions 5*a*, 5*b*, 5*c* has a D-shaped cross section (or a half moon shape). That is, each roller portions has a structure that one portion of the outer diameter is different from the other portion of the outer diameter. A roller rubber 33 having a diameter smaller about 0.5 to 3 mm than the diameter of the first to third roller rubbers 5*e*, 5*f*, 5*g* formed on the respective outer peripheries of the roller portions 5*a*, 5*b*, 5*c* is formed on an outer side of each of the first roller portion 5*a* and the third roller portion 5*c*. The recording sheets P come in contact with the first to third roller rubbers 5*e*, 5*f*, 5*g* at a time other than a time that the recording sheets P are not fed, thereby preventing the images from printed improperly or the feeding roller 5 from positionally deviated.

The first to third roller rubbers 5*e*, 5*f*, 5*g* are secured to positions at about 40 mm, about 90 mm, about 150 mm, respectively, in this order from a side closer to the sheet guide 8*a*. Accordingly, when the recording sheets P are postcards or the like, the sheets are conveyed by the first and second roller rubbers 5*e*, 5*f*, and when the recording sheets P are plain paper or the like such as in, e.g., B5 size or A4 size, the recording sheets P are conveyed by the first and third roller rubber 5*e*, 5*g*.

In this embodiment, the maximum outer diameter of the second roller portion 5*b* is structured to be larger than the maximum outer diameter of the first roller portion 5*a*.

That is, in this embodiment, the outer diameter of the second roller portion 5*b* is larger than the outer diameter of the first roller portion 5*a*, and the rubber thickness of the first and second roller rubbers 5*e*, 5*f* are the same thickness, so that the outer diameter of the second roller rubber 5*f* is larger than the outer diameter of the first roller rubber 5*e*.

Figure 8:
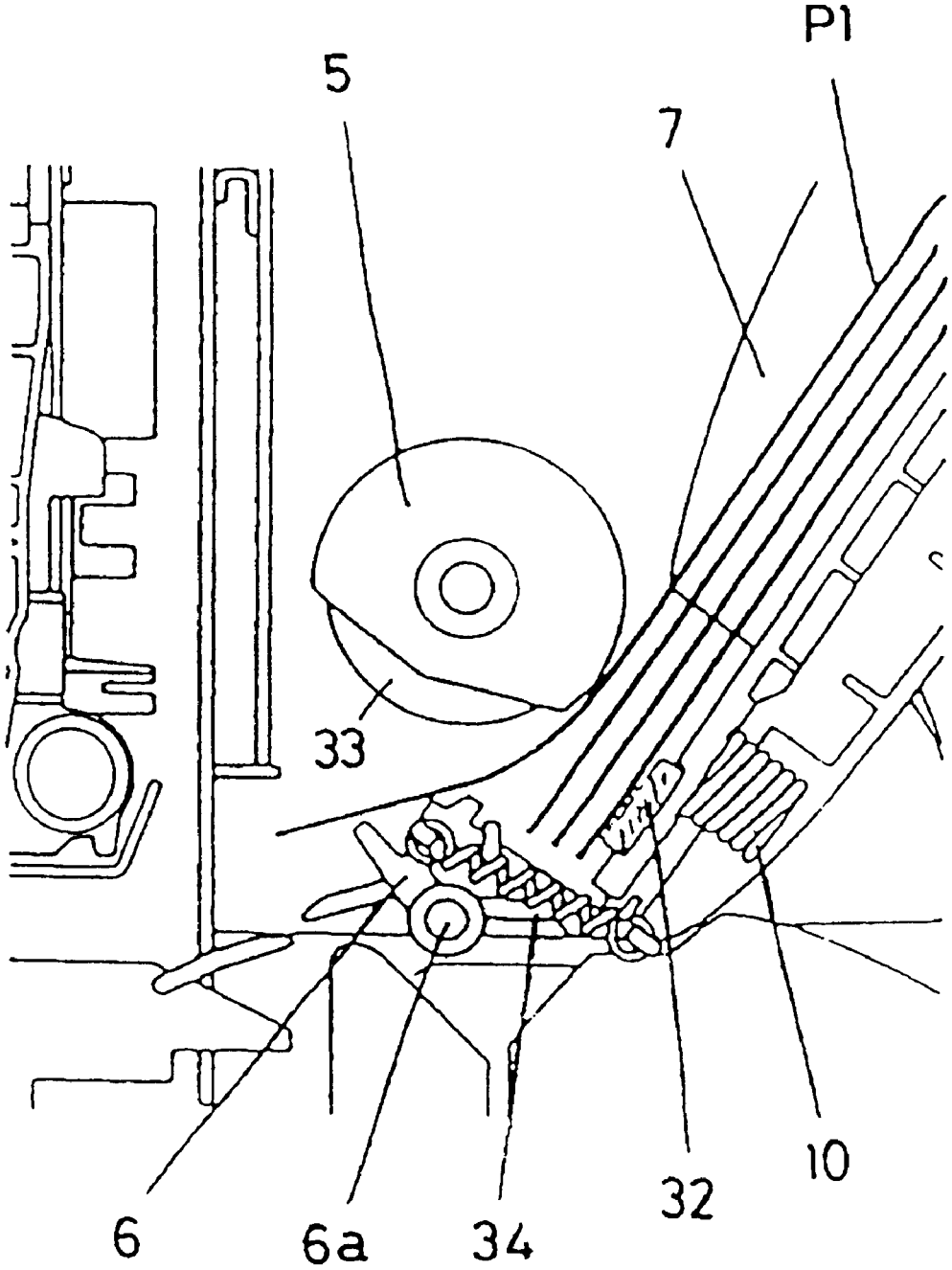
FIG. 8 is a schematic side view showing the separation feeding state when the sheet material is a postcard.

Meanwhile, the separation pawl 6 is rotatable around a rotation shaft 6*a* as shown in FIG. 8 and normally urged toward the recording sheets P by a pawl spring 34. The pressing pressure of the pawl spring 34 is set between 10 and 50 gf. The separation pawl 6 separates the recording sheets P during feeding, and in this embodiment, the separation pawl 6 is provided only on a side of the sheet guide 8*a*.

When the recording sheets P1 of rigidity such as postcards, or the like, since the rigidity of the recording sheets P1 overcomes the spring pressure of the pawl spring 34, the recording sheets P1 pushes down the separation pawl 6 as to rotate around the rotation shaft 6*a* as a center as shown in FIG. 8, thereby feeding the recording sheets P1.

Figure 11:
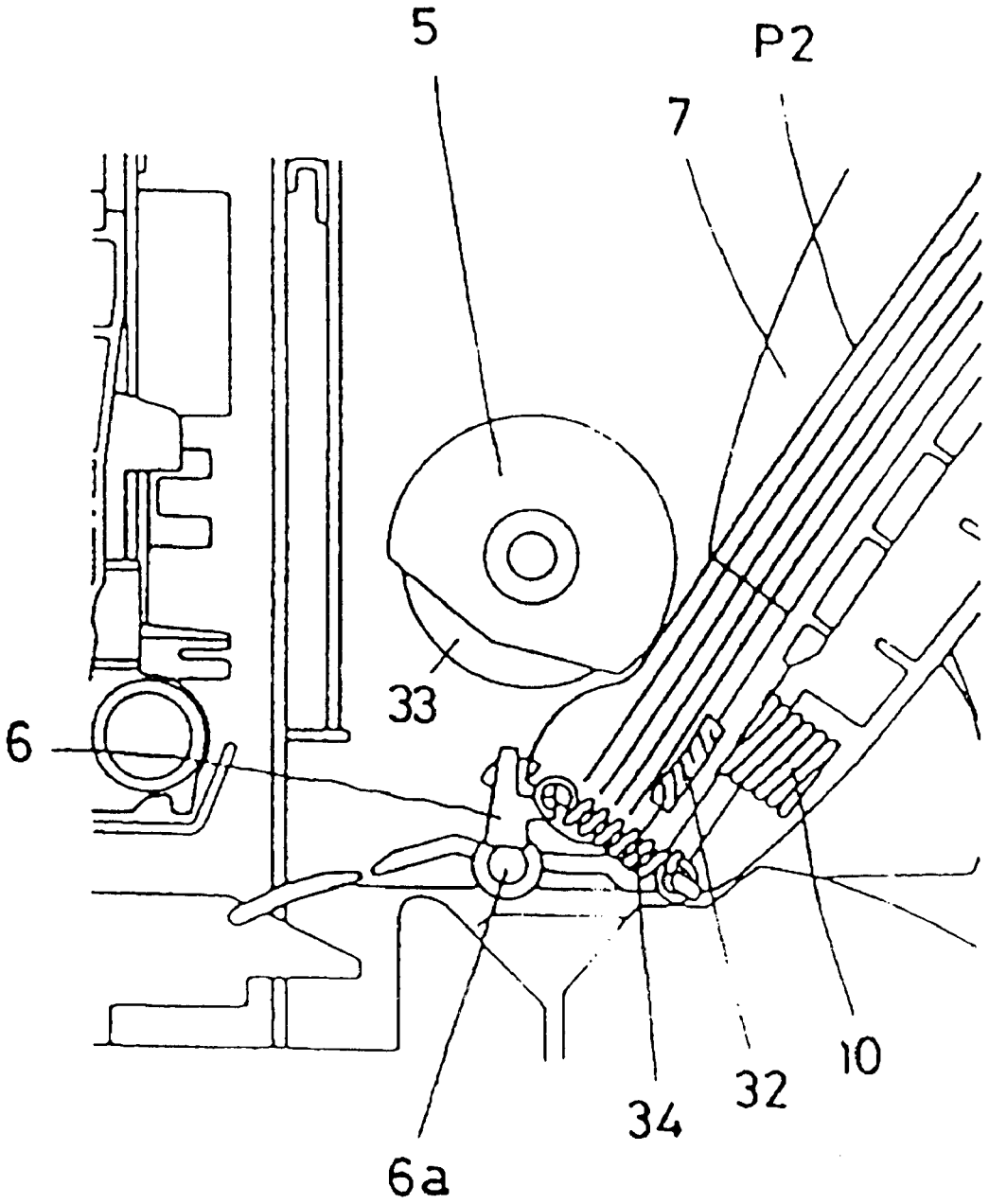
FIG. 11 is a schematic side view showing the separation feeding state when the sheet material is a plain paper.

When the recording sheets P2 of flexibility such as a plain paper or the like, since the spring pressure of the pawl spring 34 overcomes the rigidity of the recording sheets P2, the separation pawl 6 does not move as shown in FIG. 11, thereby feeding the recording sheets P2 upon separating the sheets sheet by sheet from the resistance of the separation pawl 6.

Now, prevention of oblique feeding of postcards is described in detail by a structure in which the outer diameter of the second roller rubber 5*f* is made larger than the outer diameter of the first roller rubber 5*e* as described above when the recording sheets P1 are the postcards.

In this embodiment, separation for the recording sheets P at the feeding section 1 is done by the sole separation pawl 6 provided on the side of the sheet guide 8*a*. As described above, the separation pawl 6 operates differently according to the kinds of the recording sheets P because plain paper as well as card board paper is separated automatically as described above.

Figure 6:
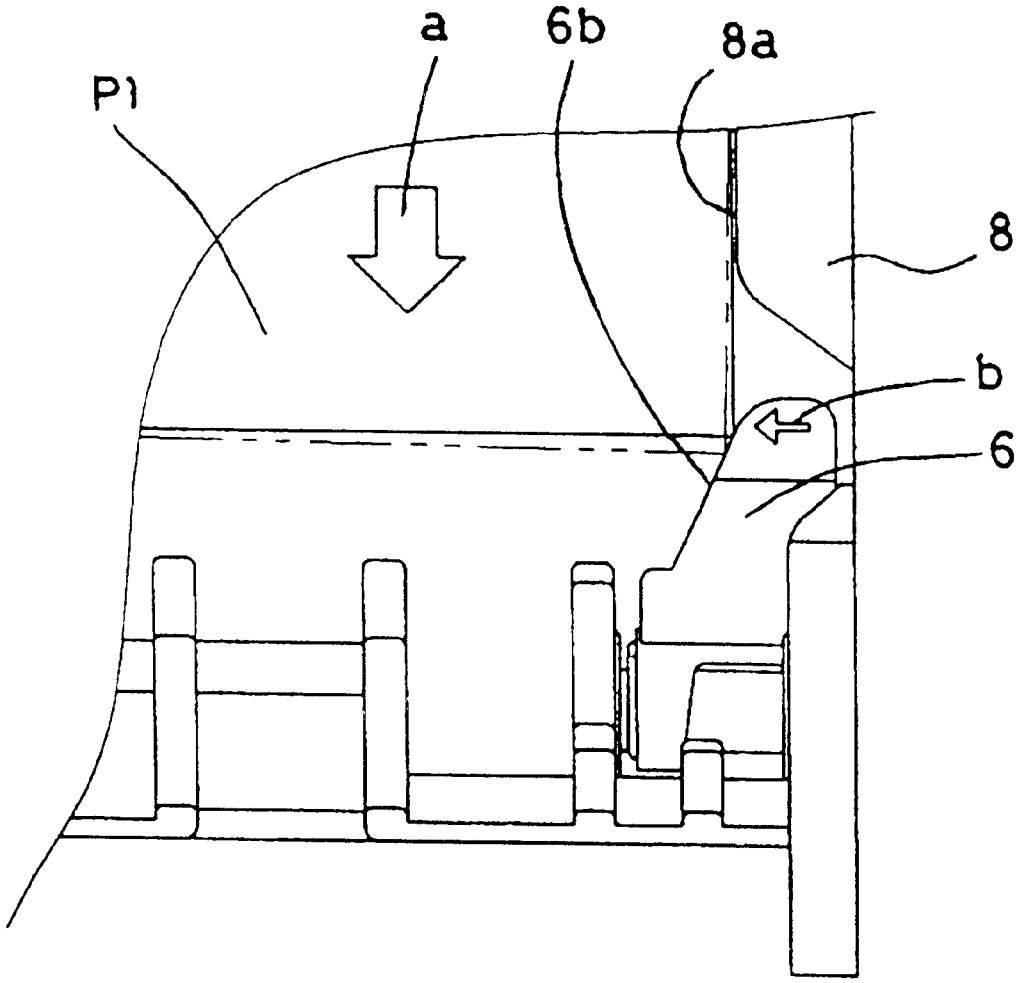
FIG. 6 is a front view showing operation of the sheet material to be fed in a direction that the front end of the sheet material goes away from a guide member by means of a tapered shape portion formed at a separation means when the sheet material is a postcard.
Figure 7:
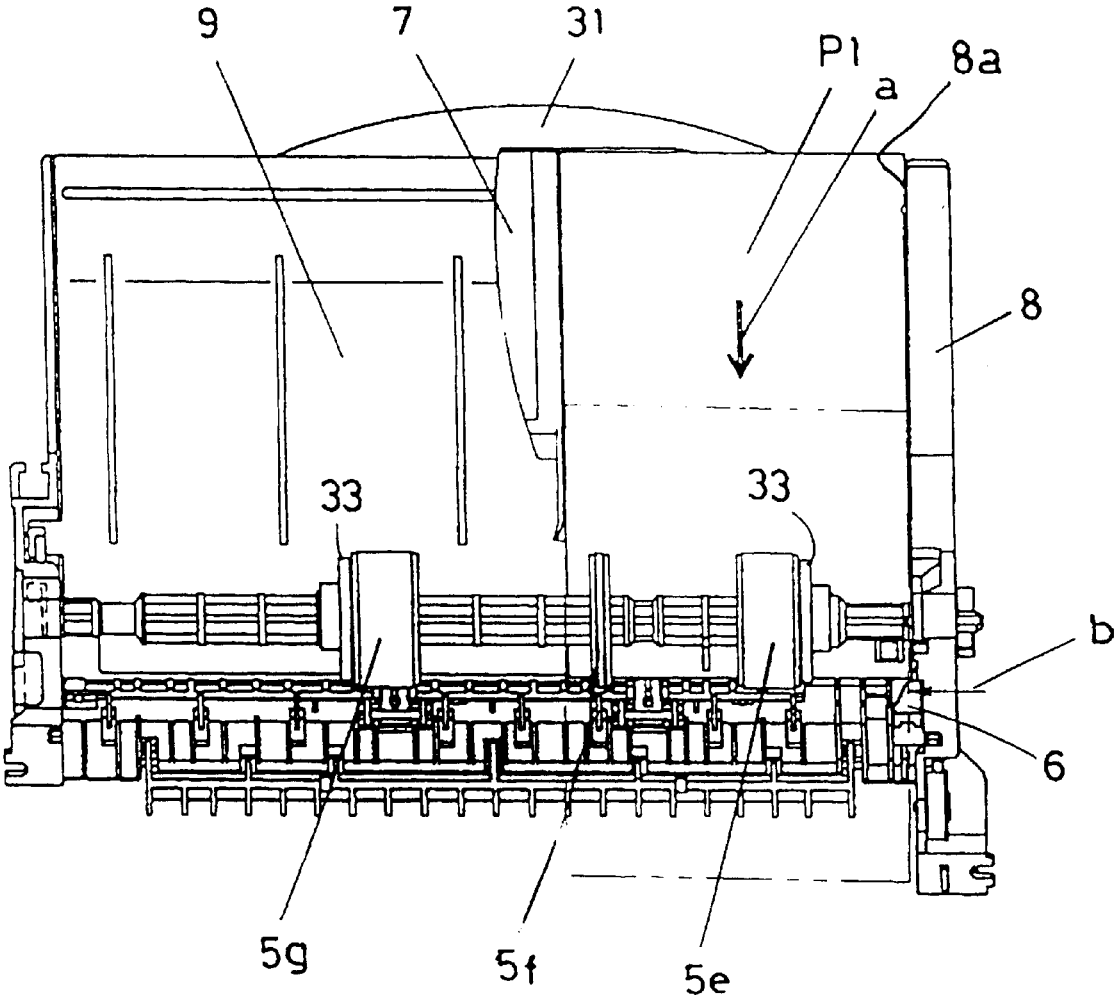
FIG. 7 is a front view showing a separation feeding state when the sheet material is a postcard.

When postcards P1 are fed, the separation pawl 6 is pushed down by the rigidity of the postcards P1. The separation pawl 6 for functioning as a separator for plain paper P2 as shown in FIG. 6 has a tapered portion 6*b* at one portion of the pawl 6. Consequently, the tapered portion 6*b* of the separation pawl 6 gives force in a direction of arrow b in FIG. 6 to the postcards P1 while the postcards P1 proceed in a direction of arrow a in FIG. 6, and the front end of the postcards P1 likely proceeds in a direction of arrow b in FIG. 6 which is going away from the sheet guide 8*a*, and as a result, an oblique feeding as show by a broken line in FIG. 6 may occur.

In this embodiment, to prevent the sheets from fed obliquely, the outer diameter of the second roller rubber 5*f* is made larger than the outer diameter of the first roller rubber 5*e*, so that the postcards P1 are prevented from obliquely fed by avoiding operation of the postcards P1 to be sent in a direction (direction of arrow b in FIG. 6) that the front end of the postcards P1 is going away from the sheet guide 8*a* according to the tapered shaped portion 6*b* formed at the separation pawl 6, because the feeding amount of the postcards P1 done by the second roller rubber 5*f* is more than the feeding amount of the postcards P1 done by the first roller rubber 5*e*.

Figure 9:
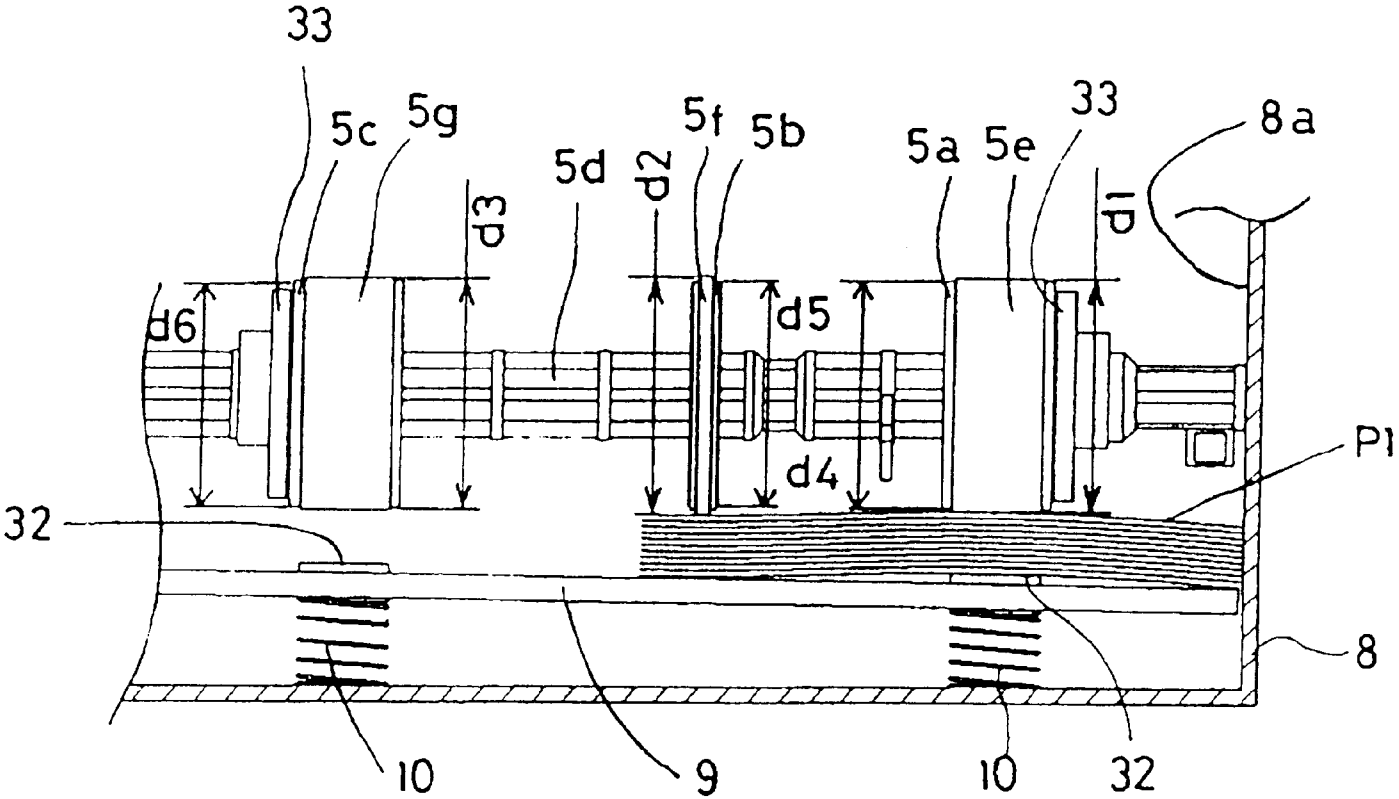
FIG. 9 is a front cross-sectional view showing the separation feeding state when the sheet material is a postcard.

This can be realized by feeding only by the right and left roller rubber 5*e*, 5*f* in FIG. 9, the first roller rubber 5*e*, and the second roller rubber 5*f*, during feeding of the postcards P1 as shown in FIG. 9.

Figure 5:
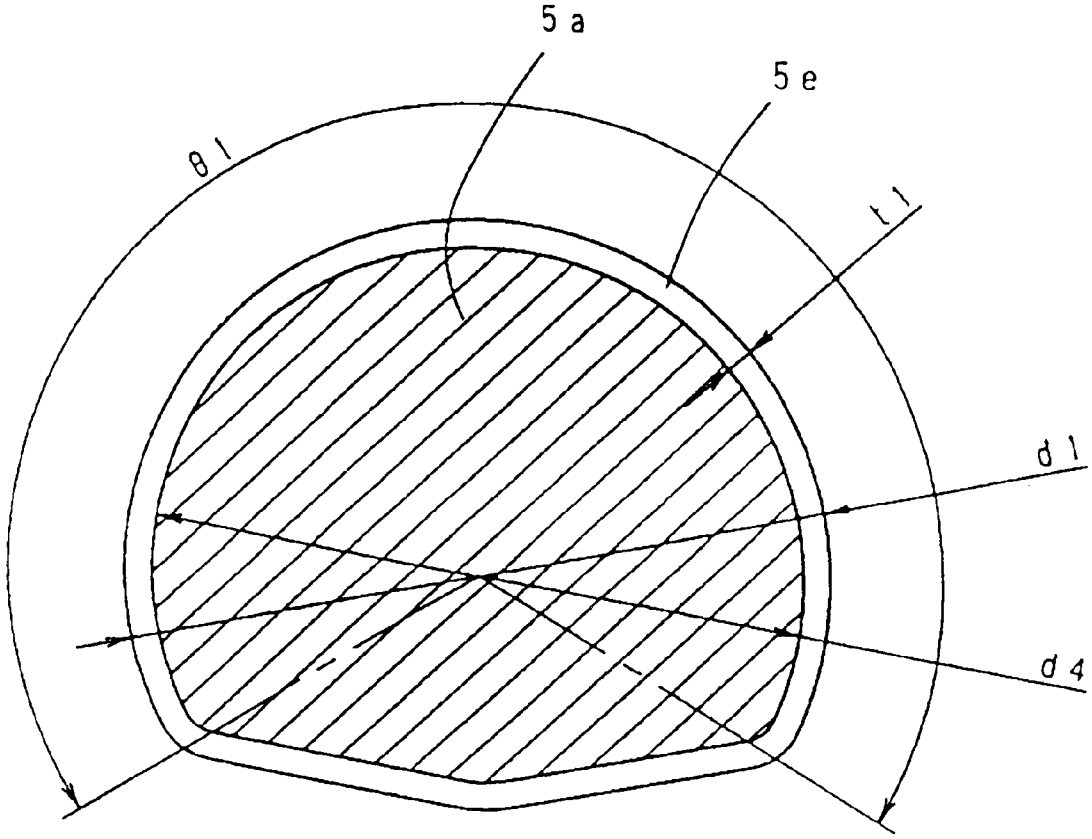
FIG. 5 is a cross section showing a structure of the sheet material feeding means.

In this embodiment, in FIG. 5, for example, where the outer diameter d4 of the first roller portion 5*a* is 35.7 mm while the outer diameter d5 of the second roller portion 5*b* is 36.4 mm, and when the thicknesses t1 of the first and second roller rubbers 5*e*, 5*f* are 1.5 mm, respectively where those roller has the same thickness, the outer diameter d1 of the first roller rubber 5*e* is 38.7 mm, and the outer diameter d2 of the second roller rubber 5*f* is 39.4 mm.

As shown in FIG. 5, the roller portions 5*a*, 5*b*, 5*c* are in a half moon shape (the same shape at three locations), and the contacting range of the roller rubber 5*e*, 5*f*, 5*g* to the recording sheets P is a portion of 240 degrees around the rotation center of the shaft 5*d* as a center.

Accordingly, the feeding amount of the recording sheets P done by the first roller rubber 5*e* is about 81 mm, and the feeding amount of the recording sheets P done by the second roller rubber 5*f* is about 82.5 mm, so that the feeding amount by the second roller rubber 5*f* is larger by about 1.5 mm. This amount is the correction amount in oblique feeding done by the postcards P1 in this embodiment.

That is, though the front end of the postcards P1 tends to be fed in a direction (direction of arrow b in FIG. 6) away from the sheet guide 8*a* according to the tapered shaped portion 6*b* formed at the separation pawl 6, the postcards P1 are prevented from obliquely fed by feeding the postcards P1 by the second roller rubber 5*f* about 1.5 mm more than the first roller rubber 5*e*, so that the postcards P1 are finally fed straight.

Figure 12:
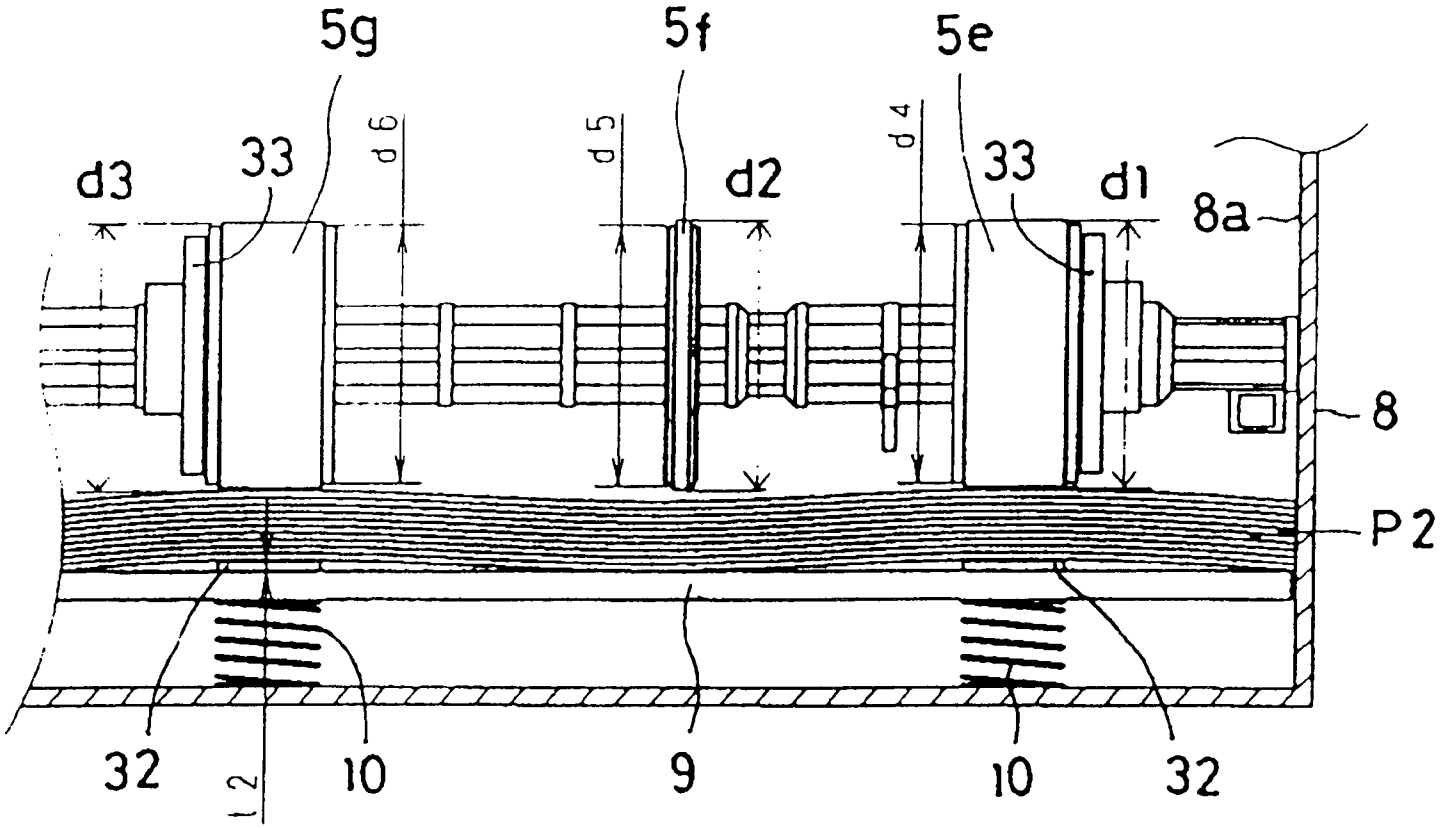
FIG. 12 is a front cross-sectional view showing the separation feeding state when the sheet material is a plain paper.

It is to be noted that in this embodiment when plain paper P2 is fed, the state is as shown in FIG. 12. As shown in FIG. 12, the difference between the radius of the first roller rubber 5*e* and the third roller rubber 5*g* and the radius of the second roller rubber 5*f* is (39.4 mm−38.7 mm)/2=0.35 mm, and a projecting amount t2 of the separation pad 32 from the pressing plate 9 is 1.15 mm. Therefore, in a case that the recording sheets P flexible like plain paper P2, the sheets follow the shapes of the pressing plate 9 and the separation pad 32, so that the recording sheets contact only with the first roller rubber 5*e* and the third roller rubber 5*g* and does not contact with the second roller rubber 5*f* in spaced by about 0.8 mm.

Consequently, where the outer diameter d2 of the second roller rubber 5*f* is made larger than the outer diameters d1, d3 of the first roller rubber 5*e* and the third roller rubber 5*g*, the structure does not affect feeding feature for plain paper P2.

It is to be noted that this invention is not restricted at all to those numbers and values according to the embodiment, and substantially the same effect can be obtained where a part of outer diameters, instead of all outer diameters, for the roller rubbers 5*e*, 5*f*, 5*g* may be changed.

According to the structure, because the maximum outer diameter of the second roller rubber 5*f* serving as the second rotary member located at a far side from the sheet guide 8*a* serving as the guide member is larger than the maximum outer diameter of the first roller rubber 5*e* serving as the first rotary member located at a near side to the sheet guide 8*a*, the feeding amount of the sheet material in a postcard size by the second roller rubber 5*f* is more than the feeding amount of the sheet material by the first roller rubber 5*e*, so that this apparatus can prevent the sheet material from fed obliquely by eliminating operation that the sheet material is fed by the tapered shape portion 6*b* of the separation pawl 6 serving as the separation means in a direction that the front end of the sheet material moves away from the sheet guide 8*a*.

Therefore, the sheet material can avoid from being fed obliquely without sacrificing usage of the apparatus as well as forming any pressing trace on the sheet material even in a case that the sheet material is in a size of a postcard or postal card.

Next, a second embodiment of a recording apparatus incorporating a sheet material feeding apparatus according to the invention is described. In the first embodiment, the structure particularly for preventing the postcards P1 from obliquely fed is described, but in this embodiment, the outer diameter d1 of the first roller rubber 5*e* is made larger than the outer diameter d3 of the third roller rubber 5*g*, thereby rendering the feeding accuracy improved for plain paper P2.

In this embodiment, an outer diameter d1, d3 of one portion of each of the first and third roller rubbers 5*e*, 5*g* serving as the first and third rotary members is different from an outer diameter of other portion, and a maximum outer diameter of the first roller rubber 5*e* is larger than a maximum outer diameter of the third roller rubber 5*g*.

In this embodiment, for example, the outer diameter d1 of the first roller rubber 5*e* is 38.7 mm; the outer diameter d2 of the second roller rubber 5*f* is 39.4 mm; the outer diameter d3 of the third roller rubber 5*g* is 38.4 mm.

Figure 10:
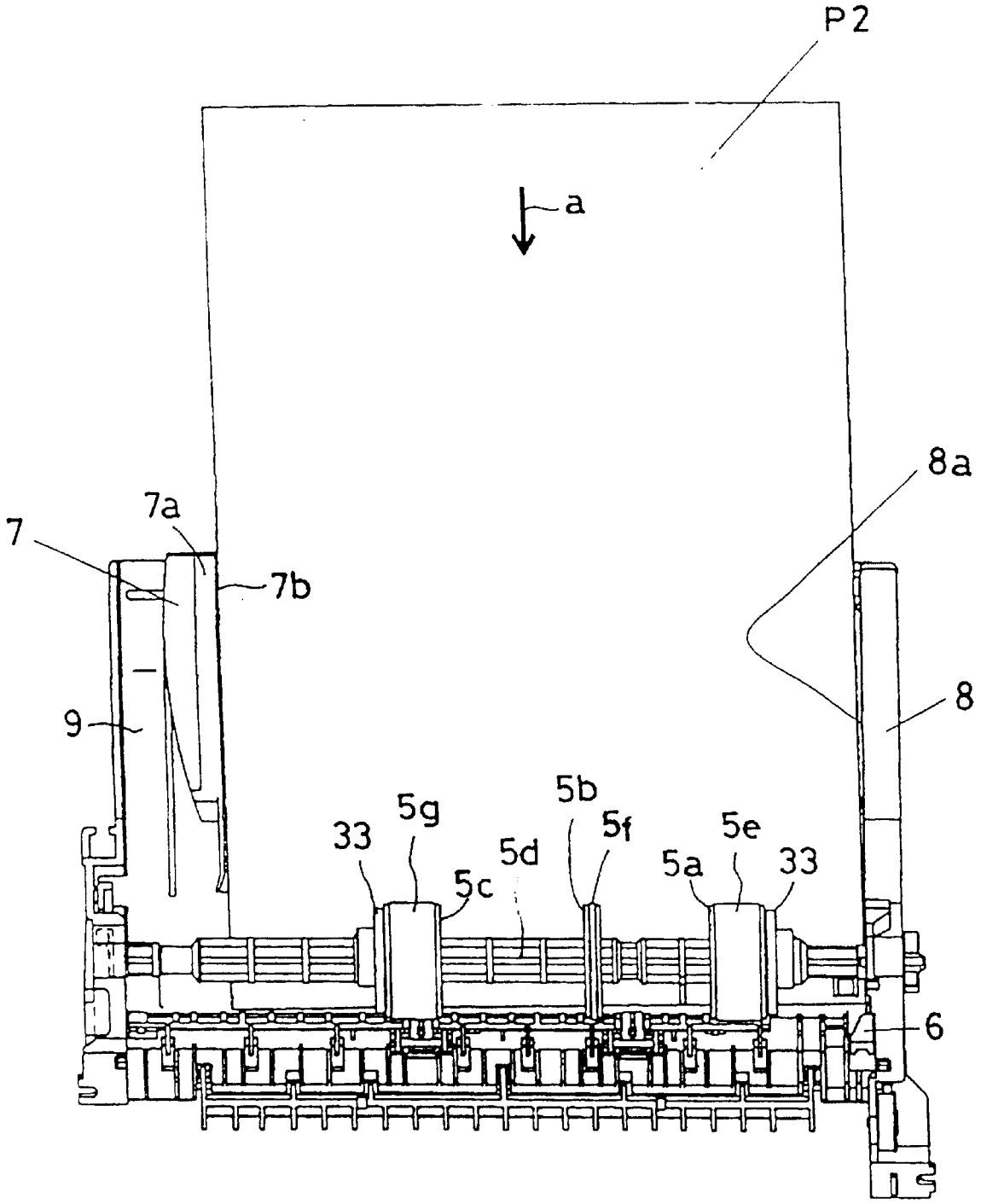
FIG. 10 is a front view showing a separation feeding state when the sheet material is a plain paper.

When the separation pawl 6 for restricting the front end of the recording sheets of flexibility such as plain paper is located only on a side of the sheet guide 8*a*, a paper stacking state of the recording sheets P2 on the pressing plate 9 may be set as shown in FIG. 10, such that a side where the separation pawl 6 does not exist tends to be drop with respect to the separation pawl 6 as a fulcrum.

If the sheet material begins to be fed from this state by pressing with the feeding roller 5 the recording sheets P2 stacked on the pressing plate 9 in rotating the feeding roller 5, the recording sheet P2 may be fed obliquely in a conventional structure. In this embodiment, because the outer diameter d1 of the first roller rubber 5*e* on the side of the sheet guide 8*a* is designed larger than the outer diameter d3 of the third roller rubber 5*g*, the feeding amount of the recording sheets P2 done by the first roller rubber 5*e* is more than the feeding amount of the recording sheets P2 done by the third roller rubber 5*g*, so that the feeding amount on the side of the sheet guide 8*a* become more, and so that the apparatus can correct the oblique feeding of the recording sheets P2 for a portion that the side where the separation pawl 6 does not exist drops with respect to the separation pawl 6 as a fulcrum.

That is, the feeding amount of the recording sheets P2 by the first roller rubber 5*e* is about 81 mm, while the feeding amount of the recording sheets P2 by the third roller rubber 5*g* is about 80.4 mm. When a plain paper P2 is fed, the feeding amount done by the first roller rubber 5*e* is about 0.6 mm more, and this amount constitutes a correction amount for oblique feeding of the plain paper P2 in this embodiment.

It is to be noted that likewise in the first embodiment, in this embodiment,the first roller rubber 5*e* and the third roller rubber 5*g* only are also in contact with plain paper P2 while the plain paper P2 is fed, and the paper is also placed with space from and does not contact with the second roller rubber 5*f* (see, FIG. 12). This structure makes the plain paper P2 as well as the postcards P1 fed with improved feeding accuracy. The other structures in this embodiment are constituted in substantially the same way as those in the first embodiment, and this embodiment can obtain substantially the same advantages.

A third embodiment of the recording apparatus having the sheet material feeding apparatus according to the invention is described next. In the first embodiment, oblique feeding correction is made by changing the feeding amounts on the left side and the right side of the postcards P1 by changing the outer diameters d1, d2 of the first roller rubber 5*e* and the second roller rubber 5*f*. In this embodiment, the outer diameters d1, d2, d3 of the respective roller rubbers 5*e*, 5*f*, 5*g* are the same; frictional coefficients of the first and second roller rubber 5*e*, 5*f* serving as the first and second rotary members are different; the frictional coefficient of the second roller rubber 5*f* is made larger than the frictional coefficient of the first roller rubber 5*e*, thereby obtaining substantially the same advantages.

That is, in this embodiment, for example, an EPDM (ethylene propylene diene monomer) rubber having a rubber hardness of 40 degrees is used for the first roller rubber 5*e*, whereas an EPDM rubber having a rubber hardness of 25 degrees is used for second roller rubber 5*f*. The frictional coefficient $\mu 1$ to the postcards P1 is 1.6 in the first roller rubber 5*e*, and the frictional coefficient $\mu 2$ to the postcards P1 is 2.0 in the second roller rubber 5*f*. The outer diameters d1, d2, d3 of the respective roller rubbers 5*e*, 5*f*, 5*g* are the same, 39.4 mm.

According to the above structure, the feeding amount of the second roller rubber 5*f* with respect to the postcards P1 is about 82.5 mm, and the first roller rubber 5*e*, since having a lower frictional coefficient to the postcards P1, is subject to a slip of about 1.8% with respect to the feeding amount to obtain the feeding amount of about 81 mm. This brings a correction effect in obliquely feeding of the postcards P1, which is substantially the same as those in the first embodiment.

Although in this embodiment, the EPDM rubber is used for the respective roller rubber 5*e*, 5*f*, 5*g*, the invention is not limited to any materials or numbers of the rubber hardness, and other materials such as urethane elastomer or the like can be used for a single side or double sides of the rubbers as far as the relation of the frictional coefficients is substantially the same as the above.

Therefore, also in this embodiment, the sheet material in a size of a postcard can avoid from being fed obliquely without sacrificing usage of the apparatus as well as forming any pressing trace on the sheet material. Other structures in this embodiment are constituted in substantially the same way as those in the first embodiment, and this embodiment can obtain substantially the same advantages. A fourth embodiment of the recording apparatus having the sheet material feeding apparatus according to the invention is described next. In the third embodiment, the structure particularly for preventing the postcards P1 from obliquely fed is described, but in this embodiment, the frictional coefficients of the first roller rubber 5*e* and the third roller rubber serving as the first and third rotary members are different, and the frictional coefficient of the first roller rubber 5*e* is designed higher than the frictional coefficient of the third roller rubber 5*g*, thereby further improving feeding accuracy in plain paper P2.

In this embodiment, an EPDM rubber having a rubber hardness of 40 degrees is used for the first roller rubber 5*e*, whereas an EPDM rubber having a rubber hardness of 50 degrees is used for third roller rubber 5*g*. The frictional coefficient $\mu 1$ to the plain paper p2 is 1.8 in the first roller rubber 5*e*, and the frictional coefficient $\mu 3$ to the plain paper p2 1.6 in the third roller rubber 5*f*. The outer diameters d1, d2, d3 of the respective roller rubbers 5*e*, 5*f*, 5*g* are the same 39.4 mm.

According to the above structure, the feeding amount of the first roller rubber 5*e* with respect to the plain paper P2 is about 82.5 mm, and the third roller rubber 5*g*, since having a lower frictional coefficient to the plain paper P2, is subject to a slip of about 0.7% with respect to the feeding amount to consequently obtain the feeding amount of about 81.9 mm. This brings a correction effect in obliquely feeding of the plain paper P2, which is substantially the same as those in the second embodiment.

Although in this embodiment, the EPDM rubber is used for the respective roller rubber 5*e*, 5*f*, 5*g*, the invention is not limited to any materials or numbers of the rubber hardness, and other materials such as urethane elastmers or the like can be used for a single side or double sides of the rubbers as far as the relation of the frictional coefficients is substantially the same as the above.

According to the above structure, the apparatus can improve the feeding accuracy of the plain paper P2, as well as the postcard P1. Other structures in this embodiment are constituted in substantially the same way as those in the first embodiment, and this embodiment can obtain substantially the same advantages.

As other embodiments of the inkjet recording apparatus as described above, an image output terminal apparatus for information processing apparatuses such as computers or the like, a photocopier combined with a reader or the like, a facsimile machine having transmitting and receiving functions, or the like can be exemplified.

Although in the above description an example using the inkjet recording method is illustrated as a recording means, the recording method used in this invention is not necessarily limited to the inkjet recording method, and other recording methods such as a thermal transfer recording method, a thermal recording method, an impact recording method such as wire dot recording methods, and the like are applicable. The recording is not limited to a serial recording method, and a so-called line recording method may be used.

What is claimed is:

1. A sheet material feeding apparatus comprising:

sheet material stacking means for stacking sheet materials;

sheet material feeding means for feeding the sheet materials stacked on the sheet material stacking means;

separation means for separating the sheet materials fed by the sheet material feeding means one by one; and a guide member for guiding one side end of the sheet material, wherein the sheet material feeding means includes first, second, and third coaxial feeding rotary members, which are formed with a sheet material contacting surface made of a high frictional material, and are respectively positioned in order from a location closer to the guide member to a location farthest from the guide member, wherein a maximum outer diameter of the second rotary member is larger than a maximum outer diameter of the first rotary member and the maximum outer diameter of the first rotary member is larger than a maximum outer diameter of the third rotary member.

2. A sheet material feeding apparatus comprising:

sheet material stacking means for stacking sheet material;

sheet material feeding means for feeding the sheet material stacked on the sheet material stacking means;

separation means for separating the sheet materials fed by the sheet material feeding means one by one; and a guide member for guiding one side end of the sheet material;

wherein the sheet material feeding means includes first, second, and third coaxial feeding rotary members, which are formed with a sheet material contacting surface made of a high friction material, and are respectively positioned in order from a location closer to the guide member to a location farthest from the guide member, wherein a maximum outer diameter of the second rotary member is larger than a maximum outer diameter of the first rotary member, and the sheet material are fed by the first and second rotary members when the sheet material is a sheet of rigidity and the sheet materials are fed by the first and third rotary members when the sheet material is an ordinary sheet to avoid the ordinary sheet from contacting with the second rotary member.

3. The sheet material feeding apparatus according to claim 1 or claim 2, wherein the separation means is a separation pawl placed only on a single side of the guide member.

4. The sheet material feeding apparatus according to claim 3, wherein the separation pawl is structured as pivotal so that when a sheet material having a thick thickness passes through the separation pawl, the separation pawl is pushed down upon pivotal movement to feed the sheet material.

5. A recording apparatus comprising:

sheet material stacking means for stacking sheet materials;

sheet material feeding means for feeding the sheet materials stacked on the sheet material stacking means;

separation means for separating the sheet materials fed by said sheet material feeding means one by one; and a guide member for guiding one side end of the sheet materials, and recording means for recording images on the sheet materials separated by the separation means;

wherein the sheet material feeding means includes first, second, and third coaxial feeding rotary members, which are formed with a sheet material contacting surface made of a high frictional material, and are respectively positioned in order from a location closer to the guide member to a location farthest from the guide member, wherein a maximum outer diameter of the second rotary member is larger than a maximum outer diameter of the first rotary member and the maximum outer diameter of the first rotary member is larger than a maximum outer diameter of the third rotary member.

6. The recording apparatus according to claim 5, wherein the recording means uses an inkjet recording method in which ink is sprayed according to signals for recording.

7. The recording apparatus according to claim 6, wherein the recording means sprays ink through an orifice using a film boiling created at the ink by thermal energy applied by an electrothermal converter.

8. A recording apparatus comprising:

sheet material stacking means for stacking sheet materials;

sheet material feeding means for feeding the sheet materials stacked on the sheet material stacking means;

separation means for separating the sheet materials fed by the sheet material feeding means one by one;

a guide member for guiding one side end of the sheet materials; and recording means for recording images on the sheet materials separated by the separation means;

wherein the sheet material feeding means includes first, second, and third coaxial feeding rotary members, which are formed with a sheet material contacting surface made of a high friction material, and are respectively positioned in order from a location closer to the guide member to a location farthest from the guide member, wherein a maximum outer diameter of the second rotary member is larger than a maximum outer diameter of the first rotary member, and the sheet materials are fed by the first and second rotary members when the sheet materials are sheets of rigidity and the sheet materials are fed by the first and third rotary members when the sheet materials are ordinary sheets to avoid the ordinary sheets from contacting with the second rotary member.

* * * * *

UNITED STATES PATENT AND TRADEMARK OFFICE

CERTIFICATE OF CORRECTION

PATENT NO. : 6,318,855 B1
DATED : November 20, 2001
INVENTOR(S) : Koichiro Kawaguchi It is certified that error appears in the above-identified patent and that said Letters Patent is hereby corrected as shown below:

Column 1,
Line 34, "as of" should read -- such as --.
Line 40, "fed" should read -- being fed --.
Line 47, "size" should read -- of the size --.
Line 49, "fed" should read -- being fed --.

Column 2,
Line 2, "fed" should read -- being fed --.
Line 34, "fed" should read -- being fed --.
Line 55, "fed" should read -- being fed --.

Column 3,
Line 23, "fed" should read -- being fed --.
Line 43, "fed" should read -- being fed --.
Line 51, "fed" should read -- being fed --.

Column 4,
Line 24, "drawings," should read -- the drawings, --.
Line 43, "printed." should read -- having been printed. --.

Column 6,
Line 32, "pulled" should read -- being pulled --.
Line 48, "from" should read -- from being --.
Line 55, "manipulated" should read -- manipulation --.

Column 7,
Line 22, "from" (both occurrences) should read -- from being --.

Column 8,
Line 20, "fed" should read -- being fed --.
Line 23, "from" should read -- from being --.

UNITED STATES PATENT AND TRADEMARK OFFICE

CERTIFICATE OF CORRECTION

PATENT NO. : 6,318,855 B1
DATED : November 20, 2001
INVENTOR(S) : Koichiro Kawaguchi It is certified that error appears in the above-identified patent and that said Letters Patent is hereby corrected as shown below:

Column 9,
Line 8, "in" should be deleted.
Line 13, "feeding" should read -- the feeding --.
Line 29, "fed" should read -- being fed --.
Line 43, "from" should read -- from being --.
Line 63, "drop" should read -- dropped --.

Column 10,
Line 22, "embodiment,the" should read -- embodiment, the --.

Column 11,
Line 16, "from" should read -- from being --.

Signed and Sealed this

Twenty-fifth Day of June, 2002

*Attest:*

*Attesting Officer*

JAMES E. ROGAN
*Director of the United States Patent and Trademark Office*